US009589576B2

(12) United States Patent
Sverrisson et al.

(10) Patent No.: US 9,589,576 B2
(45) Date of Patent: Mar. 7, 2017

(54) BANDWIDTH EXTENSION OF AUDIO SIGNALS

(71) Applicant: Telefonaktiebolaget L M Ericsson (publ), Stockholm (SE)

(72) Inventors: Sigurdur Sverrisson, Kungsängen (SE); Erik Norvell, Stockholm (SE); Volodya Grancharov, Solna (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

(21) Appl. No.: 14/355,532

(22) PCT Filed: Oct. 19, 2012

(86) PCT No.: PCT/SE2012/051117

§ 371 (c)(1),
(2) Date: Apr. 30, 2014

(87) PCT Pub. No.: WO2013/066244

PCT Pub. Date: May 10, 2013

(65) Prior Publication Data

US 2014/0288925 A1 Sep. 25, 2014

Related U.S. Application Data

(60) Provisional application No. 61/555,090, filed on Nov. 3, 2011.

(51) Int. Cl.

| | |
|---|---|
| ***G10L 21/00*** | (2013.01) |
| ***G10L 21/038*** | (2013.01) |
| *G10L 19/00* | (2013.01) |

(52) U.S. Cl.

CPC ..... *G10L 21/038* (2013.01)

(58) Field of Classification Search

CPC ..... G10L 19/002; G10L 19/083; G10L 19/10; G10L 19/12; G10L 19/26; G10L 21/038; G10L 25/24; G10L 25/78

(Continued)

(56) References Cited

U.S. PATENT DOCUMENTS

2011/0099004 A1 4/2011 Krishnan et al.

FOREIGN PATENT DOCUMENTS

WO WO 2011148230 A1 * 12/2011

OTHER PUBLICATIONS

International Search Report, PCT Application No. PCT/SE2012/051117, Jan. 2, 2013.

(Continued)

*Primary Examiner* — Thierry L Pham
(74) *Attorney, Agent, or Firm* — Patents on Demand, P.A.; Brian K. Buchheit; Scott M. Garrett

(57) ABSTRACT

Audio decoder and method therein for supporting bandwidth extension (BWE) of a received signal. The method involves receiving a first signal representing the lower frequency spectrum of a segment of an original audio signal; receiving a second signal, being a BWE signal, representing a higher frequency spectrum of the segment of the original audio signal. The method further comprises determining a degree of voicing in the lower frequency spectrum of the audio signal, based on the received first signal; and selecting a spectral tilt adaptation filter, out of at least two spectral tilt adaptation filters having different spectral attenuation characteristics, based on the determined degree of voicing. The selected spectral tilt adaptation filter is then applied on the received second signal. Thus, a differentiation of spectral tilt in the higher frequency spectrum of a reconstructed audio signal, based on lower frequency spectrum characteristics of the original audio signal is enabled.

11 Claims, 8 Drawing Sheets

(58) Field of Classification Search
USPC ..... 704/205, 206, 208, 214, 268, 278
See application file for complete search history.

(56) References Cited

OTHER PUBLICATIONS

Written Opinion of the International Searching Authority, PCT Application No. PCT/SE2012/051117, Jan. 2, 2013.
Pulakka et al., "Bandwidth Extension of Telephone Speech Using a Neural Network and a Filter Bank Implementation for Highband Mel Spectrum", *IEEE Transactions on Audio, Speech, and Language Processing*, vol. 19, No. 7, Sep. 2011, pp. 2170-2183.

* cited by examiner

BANDWIDTH EXTENSION OF AUDIO SIGNALS

CROSS REFERENCE TO RELATED APPLICATION

This application is a 35 U.S.C. §371 national stage application of PCT International Application No. PCT/SE2012/051117, filed on 19 Oct. 2012, which itself claims priority to U.S. Provisional Patent Application No. 61/555,090, filed 3 Nov. 2011, the disclosure and content of both of which are incorporated by reference herein in their entirety. The above-referenced PCT International Application was published in the English language as International Publication No. WO 2013/066244 A1 on 10 May 2013.

TECHNICAL FIELD

The invention relates to a method and an audio decoder for supporting bandwidth extension (BWE) of a received signal.

BACKGROUND

Most existing telecommunication systems operate on a limited audio bandwidth stemming from limitations of land-line telephony systems. Typically, for most voice services only the lower end, i.e., the low-frequency part, of the audio spectrum is transmitted.

Although the limited audio bandwidth is sufficient for most conversations, there is a desire to increase the audio bandwidth to improve intelligibility and sense of presence. Despite the fact that the capacity in telecommunication networks is continuously increasing, it is still of great interest to limit the required bandwidth per communication channel. In particular in mobile networks, smaller transmission bandwidths for each call result in a reduced power consumption in both the mobile device and the base station. This translates to energy and cost saving for the mobile operator, while the end user will experience prolonged battery life and increased talk-time. Further, with less consumed bandwidth per user, the mobile network can serve a larger number of users in parallel.

A property of the human auditory system is that the perception of sound is frequency dependent. In particular, our hearing is less accurate at higher frequencies. This has inspired so-called bandwidth extension (BWE) techniques, which are based on reconstructing a high-frequency band from a low-frequency band, and possibly also on a low number of high-band parameters, transmitted from the encoder side to the decoder side.

Since BWE is typically performed with limited resources, the perceived quality of the extended frequency region may vary. In 0-bit BWE schemes, i.e. in which no high-band parameters are transmitted from the encoder to the decoder side, it is common to attenuate the global gain of the BWE signal by scaling with a constant, i.e. multiplying all samples of the BWE signal by a constant attenuation factor, in order to conceal artifacts caused by the BWE system. However, the attenuation of the global gain of the BWE signal will also reduce the sensation of presence of the signal.

SUMMARY

Herein, an invention is suggested, for improving the perceived quality of an audio signal which has been subjected to BWE. Herein, two parts of a spectrum of an audio signal will be discussed: One "lower" part, or "low-band signal", and one "higher" part, or "high-band signal", where the lower part may be assumed to be decoded in an audio decoder, while the higher part is reconstructed in the audio decoder using BWE.

The invention involves a novel algorithm for dynamically adjusting the spectral tilt of a BWE signal based on certain characteristics of the corresponding low-band signal.

The spectral tilt adaptation is based on an analysis of the corresponding low-band signal. More specifically, the tilt adaptation of the BWE signal is based on parameters describing a degree of voicing and preferably also a level of spectral stability of the corresponding low-band signal.

According to a first aspect of the invention, a method is provided for supporting BWE, of a received signal. The method is to be performed by an audio decoder. The method comprises receiving a first signal representing the lower frequency spectrum of a segment of an audio signal. The method further comprises receiving a second signal, being a BWE signal, representing a higher frequency spectrum of the segment of the audio signal. Further, a degree of voicing in the lower frequency spectrum of the audio signal is determined based on the received first signal. The method further comprises selecting a spectral tilt adaptation filter, out of at least two spectral tilt adaptation filters having different spectral attenuation characteristics, based on the determined degree of voicing. The selected spectral tilt adaptation filter is then applied on the received second signal.

According to a second aspect of the invention, an audio decoder is provided, for supporting BWE. The decoder comprises a receiving unit adapted to receive a first signal representing the lower frequency spectrum of a segment of an audio signal; and further adapted to receive a second signal, being a BWE signal, representing a higher frequency spectrum of the segment of the audio signal. The audio decoder further comprises a determining unit, adapted to determine a degree of voicing in the lower frequency spectrum of the audio signal, based on the received first signal. The audio decoder further comprises a selecting unit, adapted to select a spectral tilt adaptation filter, out of at least two spectral tilt adaptation filters having different spectral attenuation characteristics, based on the determined degree of voicing. The audio decoder further comprises a filtering unit, adapted to apply the selected spectral tilt adaptation filter on the received second signal.

The solution described herein is an improvement to the BWE concept, commonly used in audio coding. The presented algorithm improves the resemblance of the spectral tilt in a BWE region of a reconstructed audio signal to the spectral tilt of the corresponding high-frequency region of the original audio signal in certain segments, thus providing an improved perceptual quality of the reconstructed signal in said certain segments, as compared to prior art solutions. The solution exploits that unvoiced audio signals are noise-like, and therefore it is possible to use a high-band signal attenuation which increases less rapidly with frequency for such unvoiced signals, as compared to a high-band signal attenuation for voiced audio signals, without emphasizing artifacts.

The method and audio coder described above may be implemented in different embodiments. For example, in addition to the degree of voicing, a level of spectral stability in the lower frequency spectrum of the audio signal may be determined, based on the received first signal. Then, the selection of the spectral tilt adaptation filter may further be based on the determined level of spectral stability. This addition has the advantage of making the algorithm more robust in regard of background noise comprised in the audio signal.

Further, a first spectral tilt adaptation filter may be selected when the determined degree of voicing fulfills a first predefined criterion, and also when the degree of voicing does not fulfill the first predefined criterion, but the level of spectral stability fulfills a second predefined criterion. A second spectral tilt adaptation filter may be selected when neither the degree of voicing fulfills the first predefined criterion, nor the level of spectral stability fulfills the second predefined criterion. The first and second predefined criteria may be represented by respective threshold values. The first spectral tilt adaptation filter may have an aggressive spectral attenuation characteristic and the second spectral tilt adaptation filter may have a less aggressive spectral attenuation characteristic, as compared to the first.

According to a third aspect, a mobile terminal is provided, comprising an audio decoder according to the second aspect above.

According to a fourth aspect, a computer program is provided, which comprises computer program code, the computer program code being adapted, if executed on a processor, to implement the method according to the first aspect above.

According to a fifth aspect, a computer program product is provided, comprising a computer readable medium and a computer program according to the fourth aspect.

BRIEF DESCRIPTION OF THE DRAWINGS

The above, as well as additional objects, features and advantages of the present invention, will be better understood through the following illustrative and non-limiting detailed description of embodiments of the present invention, with reference to the appended drawings, in which.

All the figures are schematic, not necessarily to scale, and generally only show parts which are necessary in order to elucidate the invention, wherein other parts may be omitted or merely suggested.

DETAILED DESCRIPTION

Figure 1:
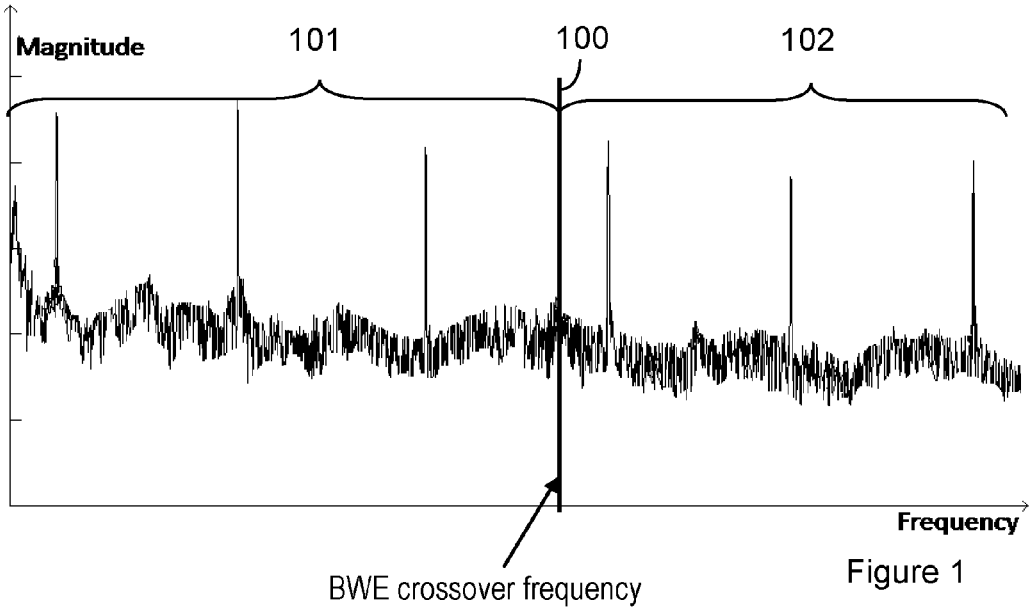
FIG. 1 shows a frequency spectrum divided into low-band frequencies and high-band frequencies at a BWE crossover frequency

FIG. 1 shows a spectrum of an original audio signal, i.e. the spectrum of an audio signal as seen at the encoder side of a codec. Herein, two parts of a spectrum of an audio signal will be discussed: One "lower" part 101 and one "higher" part 102. The lower part 101 comprises lower frequencies than the part which will be subjected to-bandwidth extension, which is the higher part 102. Herein, expressions like "the lower part", "lower bandwidth", "low-band", "LB" or "the low/lower frequencies" will be used to refer to the part of the audio spectrum below a BWE crossover frequency 100. Analogously, expressions like "the upper part", "upper bandwidth", "high-band", HB" or "the high/higher frequencies" refer to the part of the audio spectrum above a BWE crossover frequency 100.

Further, a "high" and "low" degree of voicing and level of stability will be discussed herein. A high degree of voicing may be determined when a parameter related to voicing fulfills a criterion, and correspondingly, a low degree of voicing may be determined when the same parameter does not fulfill the criterion. The criterion may be related to a threshold value, which may be set e.g. based on listening tests. A similar reasoning may be assumed for a "high" and "low" level of stability of a signal.

Further, in the field of audio processing, the term "gain" is often used both to describe an augmentation of a signal and to describe an attenuation of a signal, then implicating a gain less than 1 (one). Herein, the terms "attenuation" or "attenuation factor" are used instead of "gain" in some sections for reasons of clarity, when referring to a gain less than 1.

Figure 2:
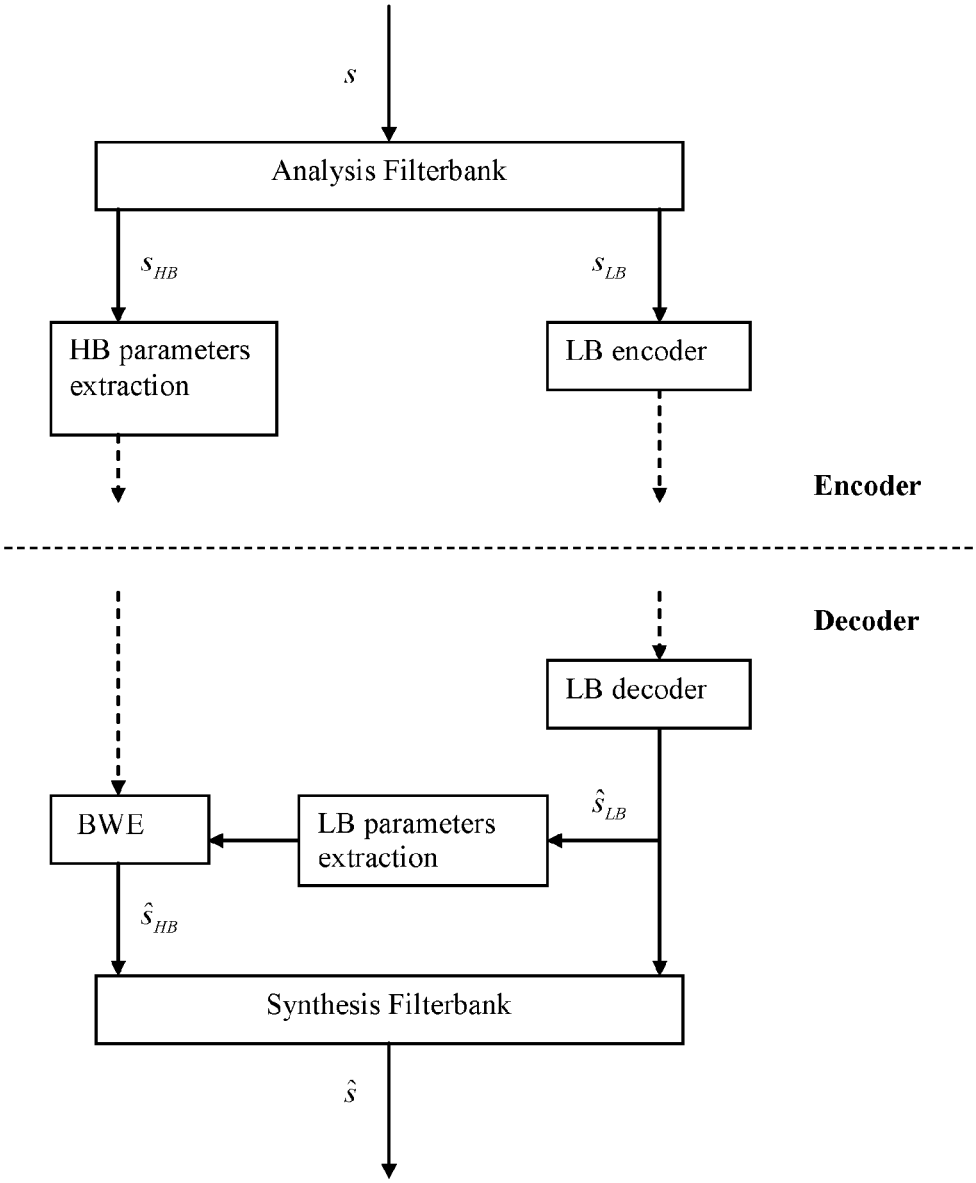
FIG. 2 shows a general overview of the principle of parametric BWE.

The herein suggested technology is mainly related to a parametric BWE scheme, with explicitly transmitted LP parameters (parameters from Linear Prediction analysis) for the HB signal. In a system applying parametric BWE, a higher quality reconstructed HB signal can be achieved, as compared to 0-bit BWE systems. A general diagram of parametric BWE is presented in FIG. 2. A parametric BWE algorithm has access to both an explicitly transmitted set of high-band parameters, as well as reconstructed low-band signal. Such parametric BWE schemes of today uses one constant attenuation factor for attenuating the HB signal in order to avoid artifacts in the reconstructed signal. As previously described, the use of such a constant attenuation factor, i.e. attenuation, reduces the sense of presence in the reconstructed signal.

Figure 3:
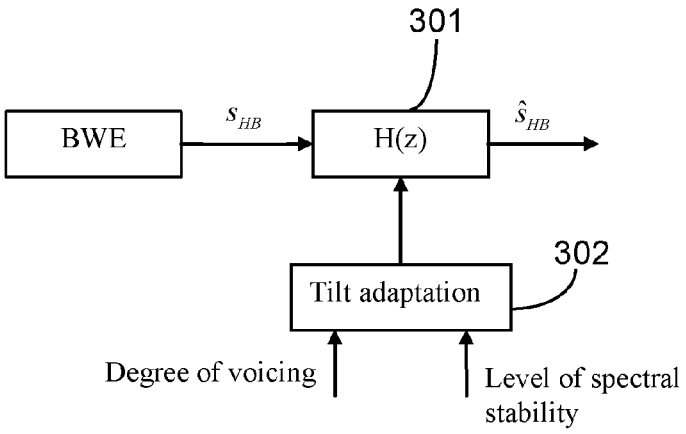
FIG. 3 shows a general block diagram of an exemplifying embodiment of the invention.

The herein suggested solution involves applying and controlling a spectrum tilt filter to the BWE signal. This filter could and will be referred to as a "spectral tilt adaptation filter", or "spectral tilt correction filter". A spectrum tilt adaptation filter is illustrated in FIG. 3 as the filter 301. The filter 301 is illustrated as being controlled by a control unit 302, and may represent multiple filter realizations. The filter 301 could alternatively be implemented as different filter units, to/between which the BWE signal is switched. The BWE signal part is processed by a tilt correction filter. The frequency response of the filter is controlled based on low-band parameters. A tilt filter could be a low order low-pass filter, e.g. a first order filter of the form $$H(z)=1-\mu z^{-1} \quad (1)$$

where z is related to the frequency domain by $z=\exp(i\cdot\omega)$, with the frequency $\omega$ being between 0 and the Nyquist frequency, i.e., $\pi$. The filter coefficient $\mu\epsilon(-1,0)$, i.e. $-1<\mu<0$, where values close to minus one define an aggressive filtering, while values close to zero define a more conservative filtering.

Figure 4:
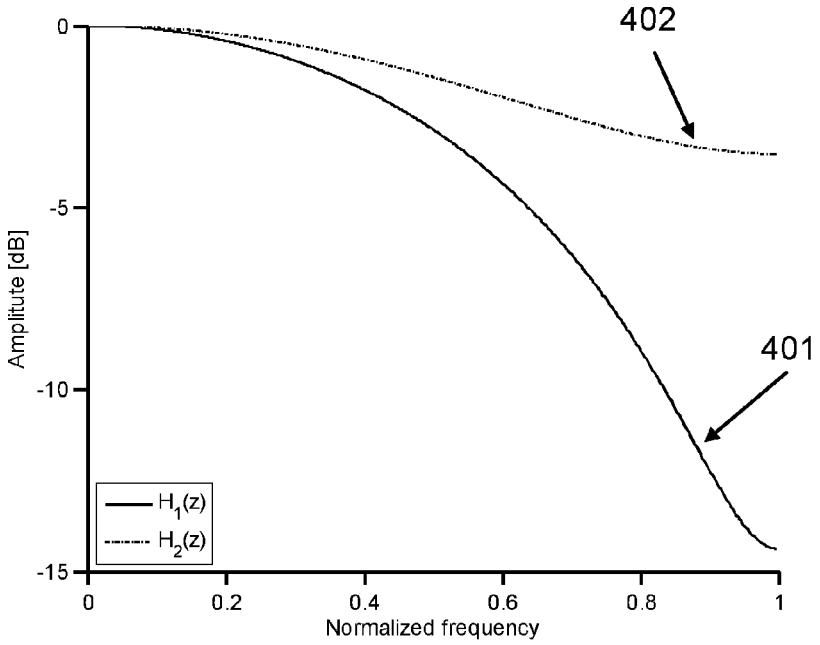
FIG. 4 exemplifies the frequency responses of two spectral tilt filters, in accordance with an exemplifying embodiment of the invention.

A suggested tilt adaptation block or function will change between e.g. two filter realizations with different values of the coefficient $\mu$, where one of the two filter realizations represents an aggressive tilt filter and the other represents a less aggressive tilt filter. If preferred, more than two filters could be used. For an illustration of an "aggressive" filter and a "less aggressive" filter, see FIG. 4, where the solid curve 401 illustrates the frequency response of an aggressive filter $H_1(z)$ and the broken curve 402 illustrates a less aggressive filter $H_2(z)$. An example of an aggressive filter $H_1(z)$ and conservative (less aggressive) filter $H_2(z)$ are given in Equations (2a) and (2b), respectively.

$$H_1(z)=1+0.68z^{-1} \tag{2a}$$

$$H_2(z)=1+0.2z^{-1} \tag{2b}$$

More generally, the frequency response of the first, aggressive, spectral tilt adaptation filter $H_1(z)$ is such that the attenuation increases more rapidly with frequency than that of the second, less aggressive, spectral tilt adaptation filter $H_2(z)$. Instead of "more aggressive" and "less aggressive", the frequency response could be described, e.g., as having more or less high frequency, HF, spectral attenuation, or as having a high or low HF roll-off.

The tilt adaptation, i.e. the changing between different filters, is based on a degree of voicing of the low-band signal and preferably also a spectral stability of the low-band signal, as will be described in the following. The suggested logic of the tilt adaptation is to perform a more aggressive filtering in voiced segments of an audio signal, and limit the filter strength or "aggressiveness" in unvoiced segments of the signal. Further, e.g. in a second adaptation stage, the filter strength may also be adapted to a spectral stability measure. Adapting the spectral tilt adaptation filter, and thus the spectral tilt of the BWE signal, based on spectral stability provides robustness in relation to signals with modified statistics, such as, e.g., speech signals mixed with background noise. That is, the tilt adaptation filter may be configured or adjusted to signal statistics of a clean input signal. By clean is here meant "without added noise". For example, a speech signal captured in an environment free from disturbances and noise would be considered to be a clean speech signal. When the input signal is mixed with background noise, the statistics of the signal are no longer the same, e.g. an autocorrelation function will change, and therefore the adaptation using the filter will not be accurate. The "spectral stability" measures, or "detects", that a signal with slowly varying statistics is mixed with speech and corrects the filter. This is possible, e.g., due to that background noise, typically, is much more stationary than speech.

Figure 5:
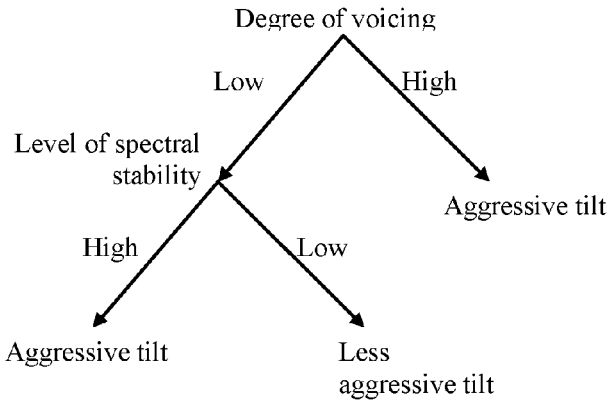
FIG. 5 illustrates a decision tree for the tilt adaptation logic, in accordance with an exemplifying embodiment of the invention.

Thus, one input feature or parameter to a functional unit which is to decide which filter to apply, is a degree of voicing of a LB signal. An example of such a functional unit is tilt adaptation unit 302 illustrated in FIG. 3. Another possible input feature or parameter is a level of spectral stability of the LB signal. When the degree of voicing in the LB signal is high, an aggressive tilt filter, e.g. $H_1(z)$,(cf. 401 in FIG. 4 and equation 2a) is selected as tilt adaptation filter. Further, when the degree of voicing is low and a level of spectral stability of the LB signal is high, which typically would be the case for background noise, an aggressive tilt filter, such as $H_1(z)$ should also be selected. However, when the degree of voicing is low and the level of spectral stability is also low, which would typically be the case for unvoiced speech, a less aggressive tilt filter, such as $H_2(z)$ (cf. 402 in FIG. 4 and equation 2b) should be selected and applied to the BWE signal. This logic is illustrated in FIG. 5. Note that it may also be beneficial to add a gain factor to the filter such that a constant pass band level may be maintained when switching between the filters.

The degree of voicing of a low-band audio signal is related to the low-band spectrum tilt. The "spectral tilt", sometimes also denoted "spectral slope" is typically defined as the normalized first autocorrelation coefficient of the speech signal, which is also the first reflection coefficient obtained during LP analysis. In LP analysis, a current sample is predicted as a linear combination of the past p samples, where p is the order of prediction The first reflection coefficient obtained during LP analysis is given by equation (4):

$$St=\frac{\sum_i \hat{s}_{LB}(i)\hat{s}_{LB}(i-1)}{\sum_i \hat{s}_{LB}^2(i)} \tag{4}$$

where $\hat{s}_{LB}(i)$ denotes sample i of the synthesized LB signal available at the decoder, and the sum is typically performed over all samples within one block or time frame, e.g., 20 ms.

As described above, the "true" spectral tilt of an input signal S is given as the first (and only) LP coefficient in an LP analysis of $1^{st}$ order. However, the LB spectral tilt can be approximated as the first LP coefficient, $a_1$, in an LP analysis of order p, also when $p\neq 1$. Typically, an LP analysis is performed up to $10^{th}$ order, i.e., p=10. The LP filter may be described by Equations (3a) and (3b)

$$H_{LP}(z)=\frac{1}{A(z)} \tag{3a}$$

where $$A(z)=1-\sum_{j=1}^{P} a_j z^{-j} \tag{3b}$$

Figure 6:
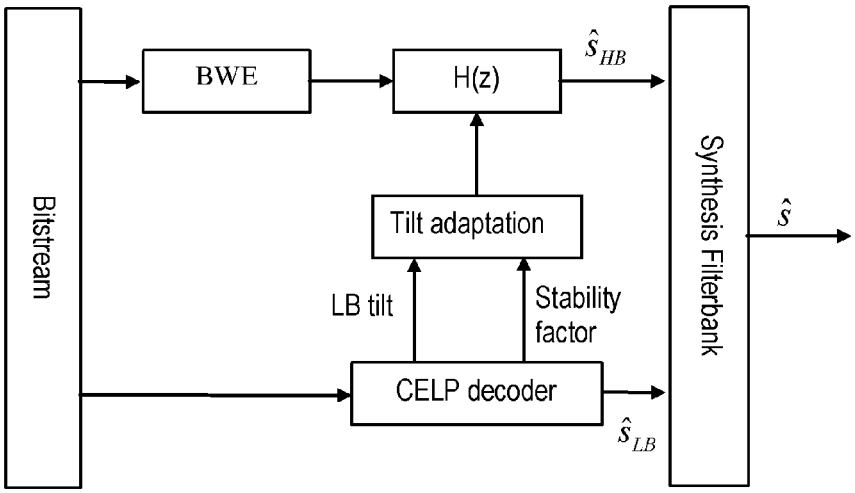
FIG. 6 shows a general block diagram of another exemplifying embodiment of the invention.

This approximation is beneficial in the case when the low-band codec is of CELP (Code Excited Linear Prediction) type, as the LP coefficients related to the low-band signal are then readily available from the CELP decoder. An embodiment of the suggested solution used in association with a CELP decoder, i.e. used in CELP coding context, is illustrated in FIG. 6.

The suggested tilt adaptation is preferably done on a per-frame basis, where a frame typically is a 20-40 ms segment of the audio signal. In order to avoid rapid fluctuation of the filter coefficients, i.e. rapid change of filter, the input parameters, i.e. the degree of voicing and the level of spectral stability, may be smoothed. The LB tilt, which reflects the degree of voicing in the LB signal, may e.g. be smoothed according to Equation (5).

$$\tilde{S}t_n=(1-\alpha)\cdot St_n+\alpha\cdot\tilde{S}t_{n-1} \tag{5}$$

where n is the frame number and a is the smoothing factor. An example value for $\alpha$ is 0.3. In order to determine whether the voicing is "high" or "low", a threshold is selected, e.g.

0 (zero). If $\tilde{St}_n$ is above the threshold then the signal may be determined to have low voicing and if $\tilde{St}_n$ is below the threshold the signal may be determined to have high voicing. A different formulation of equation 3b may give other relations, e.g. due to a change of sign of $\tilde{St}_n$.

Line spectral frequencies (LSF), also denoted Line spectral pairs (LSP), are used to represent linear prediction coefficients (LPC) for transmission over a channel. LSPs have several properties (e.g. smaller sensitivity to quantization noise) that make them superior to direct quantization of LPCs. For this reason, LSPs are very useful in speech coding. Yet an alternative representation of LP coefficients, having similar beneficial characteristics as LSF, is Immittance Spectral Frequencies (ISFs), also denoted Immittance Spectral Pairs (ISPs). These representations are well known in the technical field of speech coding, and will not be further explained herein.

The stability factor, $\theta_n$, may be calculated as the distance between the LP envelopes in consecutive frames, e.g. the present frame and the previous frame. Thus, when using LSF or ISF to represent LP coefficients, the stability factor may be calculated as a difference, in the LSF or the ISF domain, of the corresponding LSF or ISF elements in consecutive frames, see Equations (6a) and (6b).

$$\Delta f_{i,n} = \sum_{i=1}^{p} (f_{i,n} - f_{i,n-1})^2 \tag{6a}$$

$$\theta_n = 1.25 - \Delta f_{i,n} / M \tag{6b}$$

where $0 \leq \theta \leq 1$ and M is a normalizing constant with a typical value of 400000. To avoid abrupt changes from one frame to another, the stability factor may then be smoothed, e.g. according to Equation (7).

$$\tilde{\theta}_n = (1-\beta)\cdot\theta_n + \beta\cdot\tilde{\theta}_{n+1} \tag{7}$$

where n is the frame number and $\beta$ is a smoothing factor. An example value for $\beta$ is 0.95. In order to determine whether the level of spectral stability is "high" or "low", a threshold is selected, e.g. 0.83. A predefined criterion may be formulated such that if $\tilde{\theta}_n$ is e.g. less than the threshold, then the level of spectral stability may be determined to be low. Correspondingly, if $\tilde{\theta}_n$ is higher than, or equal to, the threshold, the level of spectral stability would be determined to be high. The threshold may be selected based on listening tests.

Figure 7:
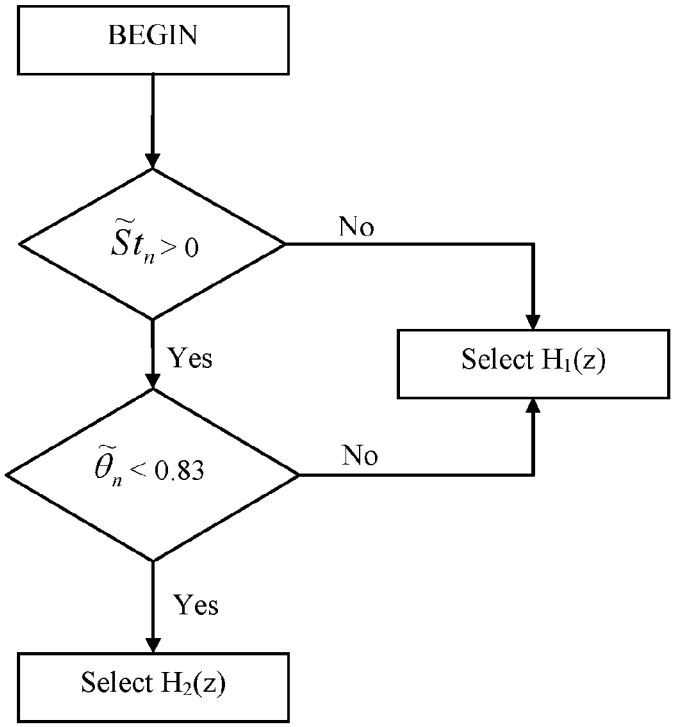
FIG. 7 shows a flow chart, in accordance with an exemplifying embodiment of the invention.

A flow chart for an exemplifying embodiment is shown in FIG. 7

Figure 8:
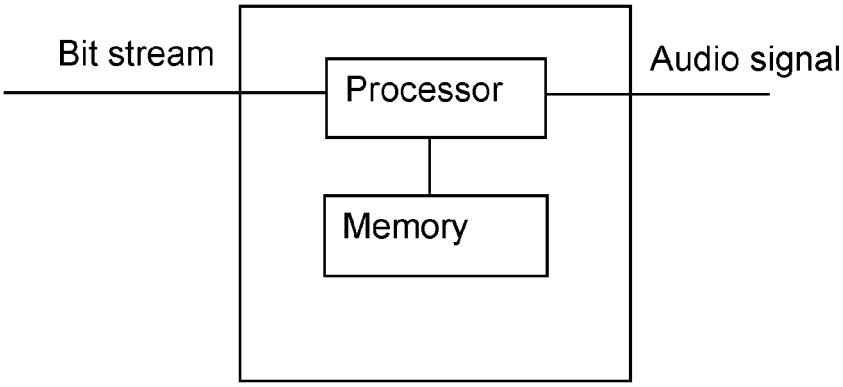
FIG. 8 shows an audio decoder, in accordance with an exemplifying embodiment of the invention.

In FIG. 8, an audio decoder in accordance with an embodiment of the invention is illustrated. The audio decoder comprises a processor and a memory. The processor may be a digital signal processor. The audio decoder is arranged for decoding a coded low-band audio signal, reconstructing a high-band audio signal by way of BWE, applying a spectral tilt correction filter to the reconstructed high-band audio signal, and synthesizing and audio signal from the decoded low-band audio signal and the reconstructed high-band audio signal. The frequency response of the spectral tilt correction filter is adjusted based on the degree of voicing and the level of spectral stability of the low-band audio signal. For this purpose, a set of instructions is loaded into the memory which, when executed by the processor, perform an embodiment of the method in accordance with the second aspect of the invention.

Figure 9:
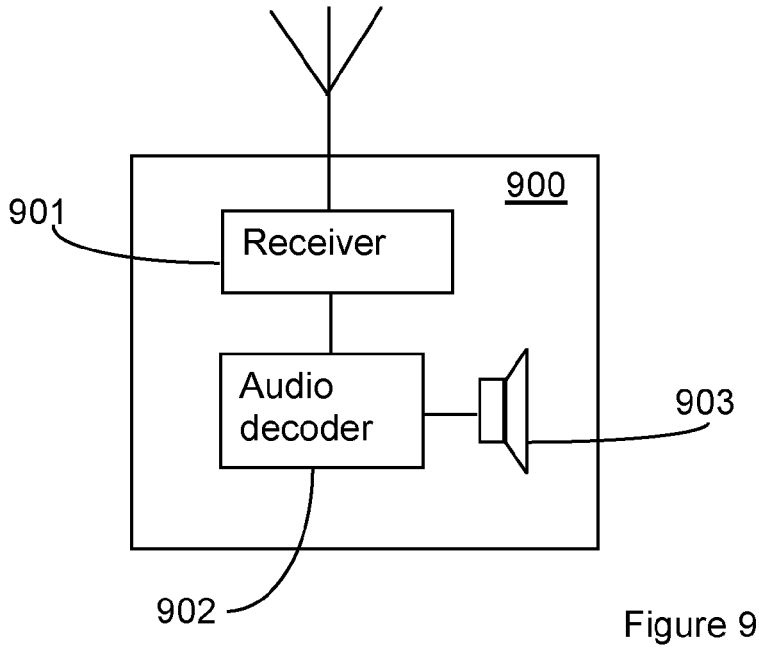
FIG. 9 shows a mobile terminal, in accordance with an exemplifying embodiment of the invention.

In FIG. 9, a mobile terminal 900 in accordance with an embodiment of the invention is illustrated. The mobile terminal 900 comprises a receiver 901, which is arranged for receiving a bitstream representing a coded low-band audio signal over a telecommunication network, an audio decoder 902 in accordance with an embodiment of the invention, and means 903 for producing audible sound, such as a loudspeaker.

Figure 10:
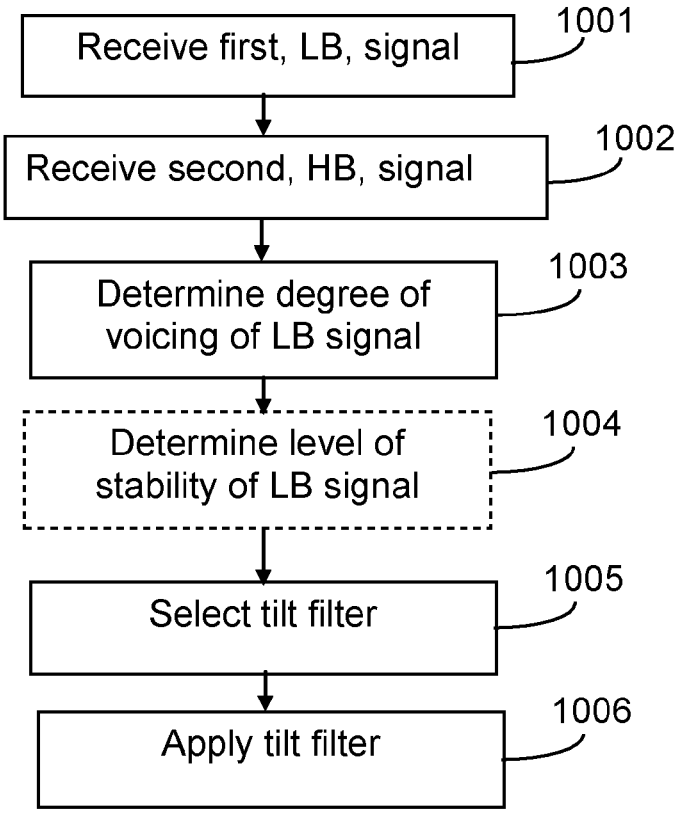
FIG. 10 is a flow chart illustrating the actions in a procedure in a transform audio decoder, according to an exemplifying embodiment.

A procedure for supporting BWE of a received signal in an audio decoder is illustrated in FIG. 10. That is, the procedure may be assumed to be performed by an audio decoder, or is performed by an audio decoder.

A first signal representing the lower frequency spectrum of a segment of an audio signal is received in a first action 1001. This may be an encoded LB signal. A second signal is received in an action 1002. The second signal is a BWE signal representing a higher frequency spectrum of the segment of the audio signal. Further, a degree of voicing in the lower frequency spectrum of the segment of the audio signal is determined in an action 1003, based on the received first signal. Then, a spectral tilt adaptation filter is selected, from out of at least two different spectral tilt adaptation filters, based the determined degree of voicing. The different spectral tilt adaptation filters have different spectral attenuation characteristics, such as the two different characteristics 401 and 402 illustrated in FIG. 4. The selected spectral tilt adaptation filter is then applied on the received second signal, i.e. the BWE signal, in an action 1006.

The procedure described above enables selecting different spectral tilt adaptation filters depending on the character of a speech signal in regard of degree of voicing. In this way, a reconstructed speech signal which better corresponds to an original speech signal may be achieved, entailing an increased sense of presence to a listener to the reconstructed signal. In the absence of background noise, the above described steps would suffice. However, when the original signal comprises background noise, a part of the signal which is determined to have a low degree of voicing is not necessarily a voiceless speech signal, but may be a section comprising background noise. When applying a spectral tilt adaptation filter, designed and intended for a speech signal with a low degree of voicing, on a signal consisting of or comprising background noise, this may result in artifacts which may be unpleasant to a listener.

In order to handle e.g. the problem of background noise, the procedure above may be extended with an action 1004, in which the level of stability in the lower frequency spectrum of the segment of the audio signal is determined based on the first signal, received in action 1001. The selection 1005 of the spectral tilt adaptation filter could then further be based on the determined level of spectral stability, which makes the procedure more robust, as previously described.

For example, a first spectral tilt adaptation filter may be selected when the degree of voicing fulfills a first predefined criterion, e.g. when the degree of voicing is determined to exceed or fall below a certain threshold. The first spectral tilt adaptation filter may also be selected when the degree of voicing does not fulfill the first predefined criterion, but the level of spectral stability fulfills a second predefined criterion, such as exceeding or falling below a certain second threshold. The first spectral tilt adaptation filter may have an aggressive spectral attenuation characteristic, increasing with frequency, cf. $H_1(z)$ 401 in FIG. 4.

A second spectral tilt adaptation filter could be selected when neither the degree of voicing fulfills the first predefined criterion, nor the level of spectral stability fulfills the second predefined criterion. The second spectral tilt adaptation filter could have a less aggressive spectral attenuation characteristic, as compared to that of the first spectral tilt adaptation filter, cf. $H_2(z)$ 402 in FIG. 4.

An exemplifying audio decoder 1100, adapted to enable the performance of the above described procedure will be described below with reference to FIG. 11. The audio decoder 1100 is illustrated as to communicate with other entities via a communication unit 1102. The part of the audio decoder which is adapted for enabling the performance of the above described procedure is illustrated as an arrangement 1101, surrounded by a broken line. The audio decoder may further comprise other functional units 1116, such as e.g. functional units providing regular decoder and BWE functions, and may further comprise one or more storage units 1114. The audio decoder 1100 could be part of a mobile terminal, as illustrated e.g. in FIG. 9, or be comprised in any other terminal or apparatus in which it is desired to decode an audio signal.

The audio decoder 1100, and/or the arrangement 1101, could be implemented e.g. by one or more of: a processor or a micro processor and adequate software with suitable storage therefore, a Programmable Logic Device (PLD) or other electronic component(s)/processing circuit(s) configured to perform the actions mentioned above in conjunction with FIG. 10.

The arrangement part 1101 of the audio decoder may be implemented and/or described as follows:

The arrangement 1101 comprises a receiving unit 1104, adapted to receive a first signal representing the lower frequency spectrum of a segment of an audio signal. This first signal may be an encoded LB signal. The receiving unit 1104, is further adapted to receive a second signal representing a higher frequency spectrum of the segment of the audio signal. The second signal is a bandwidth extended signal. The arrangement 1101 further comprises a determining unit 1106, adapted to determine a degree of voicing in the lower frequency spectrum of the audio signal, based on the received first signal. The arrangement 1101 further comprises a selecting unit 1108, which is adapted to select a spectral tilt adaptation filter, based on the determined degree of voicing. The spectral tilt adaptation filter is selected out of at least two spectral tilt adaptation filters having different spectral attenuation characteristics, cf. e.g. $H_1(z)$ and $H_2(z)$ illustrated in FIG. 4. The arrangement 1101 further comprises a filtering unit 1110, adapted to apply the selected spectral tilt adaptation filter on the received second signal, i.e. the BWE signal.

The audio decoder, e.g. the determining unit 1106, may be further adapted to determine a level of spectral stability in the lower frequency spectrum of the segment of the audio signal, based on the received first signal. The audio decoder, e.g. the selecting unit 1108, may also be further adapted to select the spectral tilt adaptation filter based on the determined level of spectral stability. That is, the selection of the spectral tilt adaptation filter may be based both on the determined degree of voicing and the determined level of spectral stability, as previously described and illustrated e.g. in FIG. 5.

A schematic exemplifying mobile terminal, which may also be denoted e.g. User Equipment (UE) comprising an exemplifying audio decoder according to an embodiment is illustrated in FIG. 9.

Figure 11:
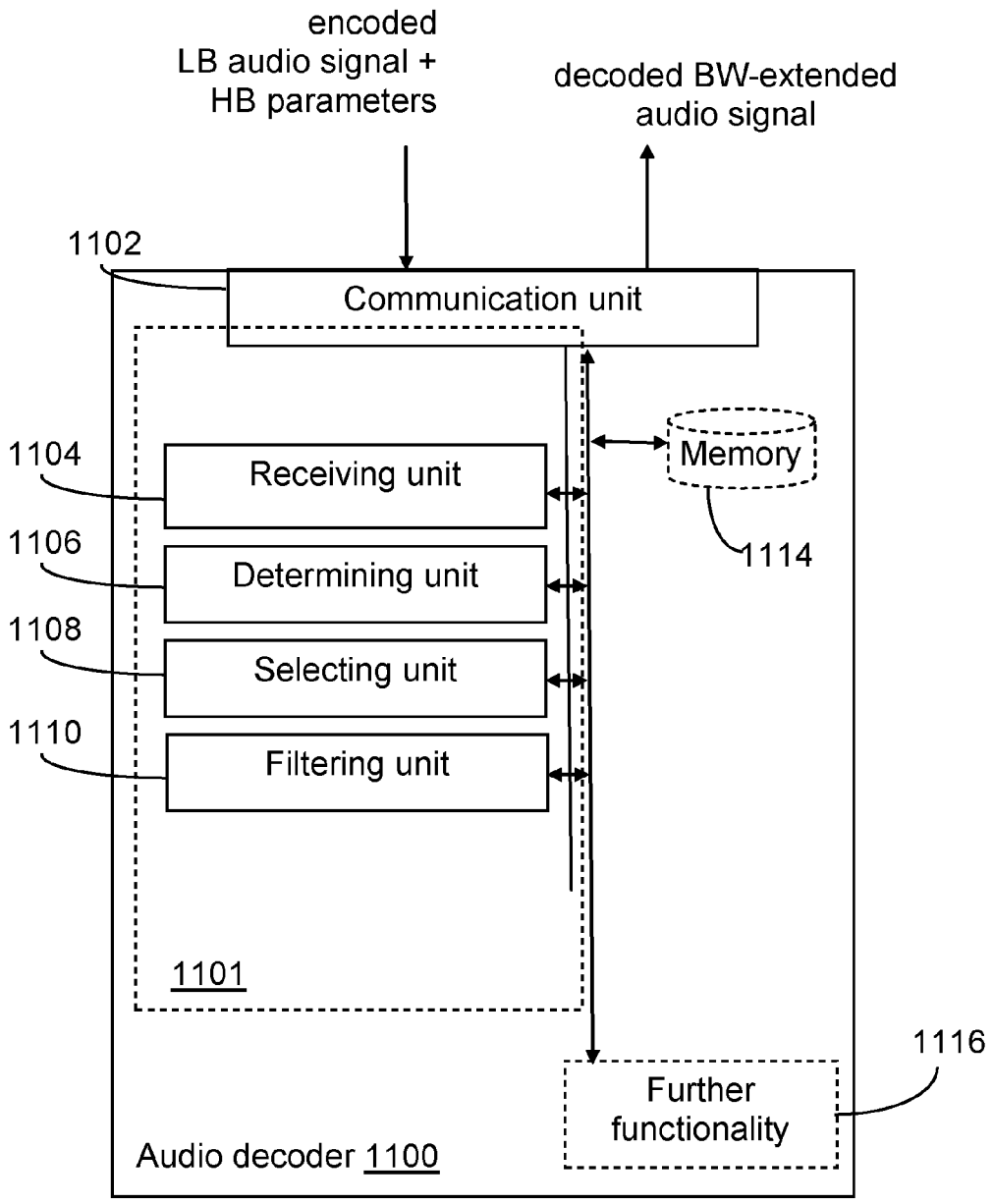
FIG. 11 is a block diagram illustrating a transform audio decoder, according to an exemplifying embodiment of the invention.
Figure 12:
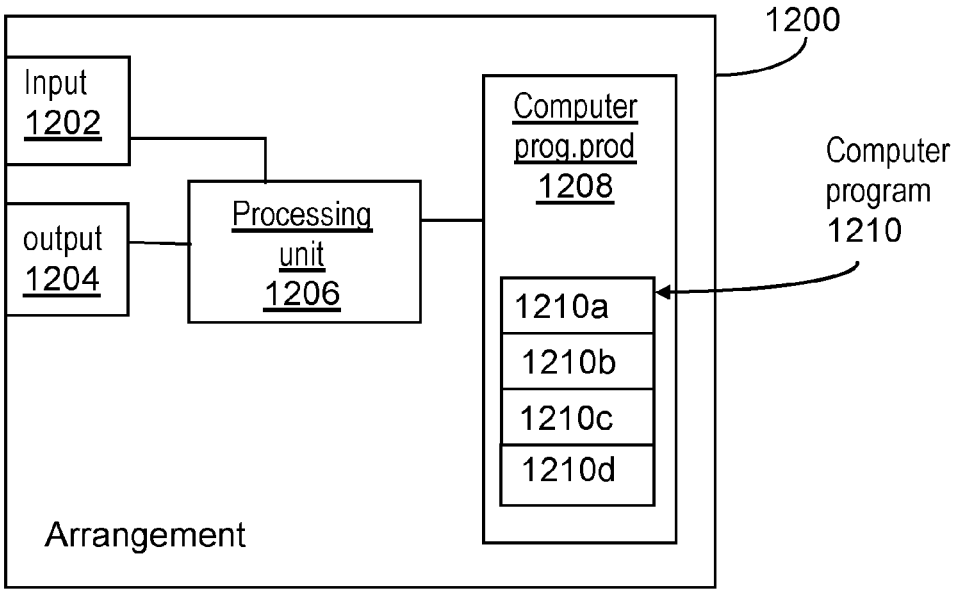
FIG. 12 is a block diagram illustrating an arrangement in a transform audio decoder, according to an exemplifying embodiment of the invention.

FIG. 12 schematically shows an embodiment of an arrangement 1200 for use e.g. in a UE, which also can be an alternative way of implementing an embodiment of the arrangement 1101 in an audio decoder illustrated in FIG. 11. Alternatively, the arrangement 1200 may be an embodiment of the whole or part of the audio decoder 1100 illustrated in FIG. 11. Comprised in the arrangement 1200 are here a processing unit 1206, e.g. with a DSP (Digital Signal Processor). The processing unit 1206 may be a single unit or a plurality of units to perform different actions of procedures described herein. The arrangement 1200 may also comprise an input unit 1202 for receiving signals from other entities, and an output unit 1204 for providing signal(s) to other entities. The input unit 1202 and the output unit 1204 may be arranged as an integrated entity.

Furthermore, the arrangement 1200 comprises at least one computer program product 1208 in the form of a non-volatile or volatile memory, e.g. an EEPROM (Electrically Erasable Programmable Read-only Memory), a flash memory, a disk drive or a RAM (Random-access memory). The computer program product 1208 comprises a computer program 1210, which comprises computer program code, which when executed in the processing unit 1206 in the arrangement 1200 causes the arrangement and/or the UE to perform the actions of any of the procedures described earlier in conjunction with FIGS. 5, 7 and 10.

The computer program 1210 may be configured as a computer program code structured in computer program modules. Hence, in an exemplifying embodiment, the computer program code in the computer program 1210 of the arrangement 1200 may comprise a receiving module **1210*a* for receiving a first signal representing the lower frequency spectrum of a segment of an audio signal, and further to receive a second signal, being a BWE signal, representing a higher frequency spectrum of the segment of the audio signal. The computer program comprises a determining module 1210*b* for determining a degree of voicing in the lower frequency spectrum of the audio signal, based on the received first signal. The computer program 1210 further comprises a selecting module 1210*c* for, selecting a spectral tilt adaptation filter, out of at least two spectral tilt adaptation filters having different spectral attenuation characteristics, based on the determined degree of voicing. The computer program 1210 further comprises a filter module 1210*d*** for applying the selected spectral tilt adaptation filter on the received second BWE signal.

The modules **1210*a-d* could essentially perform the actions indicted in FIGS. 7 and 10, to emulate e.g. the arrangement 1101 in an audio decoder illustrated in FIG. 11. In other words, when the different modules 1210*a-d* are executed in the processing unit 1206, they may correspond to the units 1104-1110 of FIG. 11**.

The processor may be a single CPU (Central processing unit), but could also comprise two or more processing units. For example, the processor may include general purpose microprocessors; instruction set processors and/or related chips sets and/or special purpose microprocessors such as ASICs (Application Specific Integrated Circuit). The processor may also comprise board memory for caching purposes. The computer program may be carried by a computer program product connected to the processor. The computer program product may comprise a computer readable medium on which the computer program is stored. For example, the computer program product may be a flash memory, a RAM (Random-access memory) ROM (Read-Only Memory) or an EEPROM, and the computer program modules described above could in alternative embodiments be distributed on different computer program products in the form of memories within the network node.

Although the computer program code in the embodiments disclosed above in conjunction with FIGS. 8 and 12 are implemented as computer program modules which when executed in the processing unit causes the arrangement and/or UE to perform the actions described above in the conjunction with figures mentioned above, at least one of the computer program modules may in alternative embodiments be implemented at least partly as hardware circuits.

It is to be understood that the choice of interacting units or modules, as well as the naming of the units are only for exemplifying purpose, and nodes suitable to execute any of the methods described above may be configured in a plurality of alternative ways in order to be able to execute the suggested process actions.

It should also be noted that the units or modules described in this disclosure are to be regarded as logical entities and not with necessity as separate physical entities.

The invention claimed is:

1. A method performed by an audio decoder for supporting bandwidth extension, BWE, of a received signal, the method comprising:

receiving, by a processor, a first signal representing the lower frequency spectrum of a segment of an audio signal;

receiving, by the processor, a second signal, being a BWE signal, representing a higher frequency spectrum of the segment of the audio signal;

determining, by the processor, a degree of voicing in the lower frequency spectrum of the audio signal, based on the received first signal;

selecting, by the processor, a spectral tilt adaptation filter, out of at least two spectral tilt adaptation filters having different spectral attenuation characteristics, based on the determined degree of voicing;

determining, by the processor, a level of spectral stability in the lower frequency spectrum of the audio signal, based on the received first signal, wherein the selection of the spectral tilt adaptation filter is further based on the determined level of spectral stability; and applying, by the processor, the selected spectral tilt adaptation filter on the received second signal.

2. The method according to claim 1, wherein the selecting involves:

selecting, by the processor, a first spectral tilt adaptation filter when the degree of voicing fulfills a first predefined criterion, and when the degree of voicing does not fulfill the first predefined criterion, but the level of spectral stability fulfills a second predefined criterion, and selecting a second spectral tilt adaptation filter: when neither the degree of voicing fulfills the first predefined criterion, nor the level of spectral stability fulfills the second predefined criterion.

3. The method according to claim 2, wherein the first and second predefined criteria are represented by respective threshold values.

4. The method according to claim 2, wherein the first spectral tilt adaptation filter has an aggressive spectral attenuation characteristic, increasing with frequency, and the second spectral tilt adaptation filter has a less aggressive spectral attenuation characteristic, as compared to the first spectral tilt adaptation filter.

5. An audio decoder for supporting bandwidth extension, BWE, of a received signal, the audio decoder comprising:

a receiving unit, adapted to receive a first signal representing the lower frequency spectrum of a segment of an audio signal; and further adapted to receive a second signal, being a BWE signal, representing a higher frequency spectrum of the segment of the audio signal;

a determining unit, adapted to determine a degree of voicing in the lower frequency spectrum of the audio signal, and a level of spectral stability in the lower frequency spectrum of the audio signal, based on the received first signal;

a selecting unit, adapted to select a spectral tilt adaptation filter, out of at least two spectral tilt adaptation filters having different spectral attenuation characteristics, based on the determined degree of voicing and the determined level of spectral stability; and a filtering unit, adapted to apply the selected spectral tilt adaptation filter on the received second signal.

6. The audio decoder according to claim 5, wherein the selecting comprises:

selecting a first spectral tilt adaptation filter when the degree of voicing fulfills a first predefined criterion, and when the degree of voicing does not fulfill the first predefined criterion, but the level of spectral stability fulfills a second predefined criterion, and selecting a second spectral tilt adaptation filter: when neither the degree of voicing fulfills the first predefined criterion, nor the level of spectral stability fulfills the second predefined criterion.

7. The audio decoder according to claim 6, wherein the first and second predefined criteria are represented by a respective threshold value.

8. The audio decoder according to claim 6, wherein the first spectral tilt adaptation filter has an aggressive spectral attenuation characteristic, increasing with frequency, and the second spectral tilt adaptation filter has a less aggressive spectral attenuation characteristic, as compared to the first spectral tilt adaptation filter.

9. A mobile terminal comprising an audio decoder according to claim 5.

10. A computer program comprising computer program code stored on a non-transitory storage medium, the computer program code being adapted, if executed on a processor, to implement the method according to claim 1.

11. A computer program product comprising a computer readable medium and a computer program stored on the non-transitory medium according to claim 10 stored on the computer readable medium.

* * * * *